US007270443B2

(12) United States Patent
Kurtz et al.

(10) Patent No.: US 7,270,443 B2
(45) Date of Patent: Sep. 18, 2007

(54) DIRECTIONAL ADJUSTABLE SWIVEL LIGHTING-FIXTURE

(75) Inventors: Richard Kurtz, 34 Franklin Dr., Plainsboro, NJ (US) 08536; Edward Ma, Great Neck, NY (US)

(73) Assignee: Richard Kurtz, Plainsboro, NJ (US)

( * ) Notice: Subject to any disclaimer, the term of this patent is extended or adjusted under 35 U.S.C. 154(b) by 85 days.

(21) Appl. No.: 11/332,720

(22) Filed: Jan. 13, 2006

(65) Prior Publication Data

US 2007/0165398 A1 Jul. 19, 2007

(51) Int. Cl.
*F21V 17/02* (2006.01)

(52) U.S. Cl. ..... 362/282; 362/322; 362/217

(58) Field of Classification Search ..... 362/217, 362/322, 282–283, 319
See application file for complete search history.

(56) References Cited

U.S. PATENT DOCUMENTS 2,318,329 A 5/1943 Popp
2,489,686 A * 11/1949 Suter ..... 362/221
4,061,946 A 12/1977 Schreurs
4,208,701 A 6/1980 Schock
4,594,647 A 6/1986 Dippert
4,598,340 A 7/1986 Dwosh et al.
4,814,958 A * 3/1989 Hsieh ..... 362/217
4,924,365 A * 5/1990 Bogdanovs ..... 362/224
5,243,505 A 9/1993 Carr
5,436,815 A * 7/1995 Grooms et al. ..... 362/216
5,499,165 A 3/1996 Holmes, Jr.
5,911,498 A * 6/1999 Shemitz et al. ..... 362/217
6,183,112 B1 2/2001 Bomas
6,463,947 B1 10/2002 Wipperfurth
6,561,677 B1 5/2003 Leen
6,722,774 B2 4/2004 Kovacik et al.
6,905,231 B2 6/2005 Dickie

* cited by examiner

*Primary Examiner*—Ali Alavi
(74) *Attorney, Agent, or Firm*—Thomas L. Adams

(57) ABSTRACT

A directional lighting fixture can receive an elongated lamp. The fixture has a spaced pair of connective devices each having a barrel with an electrical contact adapted to connect to opposite ends of the lamp. A tubular lamp cover has a light transmissive section and a light reflective section. Each section is contiguous to the other and trough-shaped. The lamp cover is rotatably mounted around the barrels of the connective devices.

19 Claims, 3 Drawing Sheets

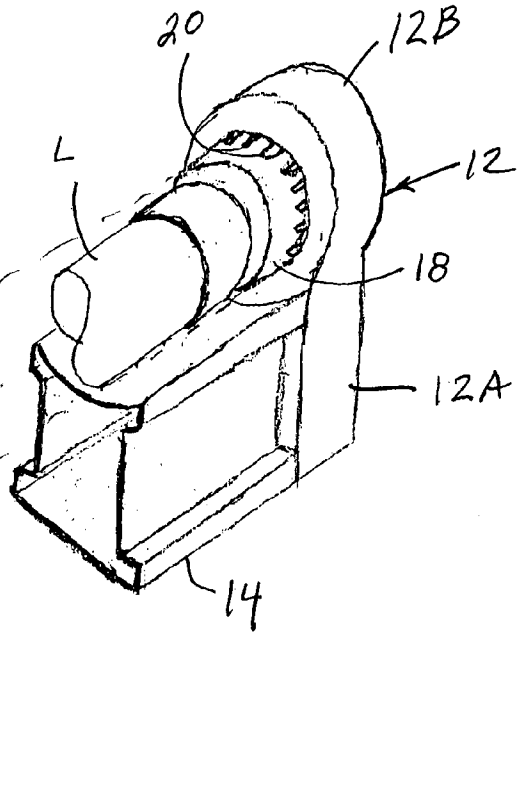
FIG. 2
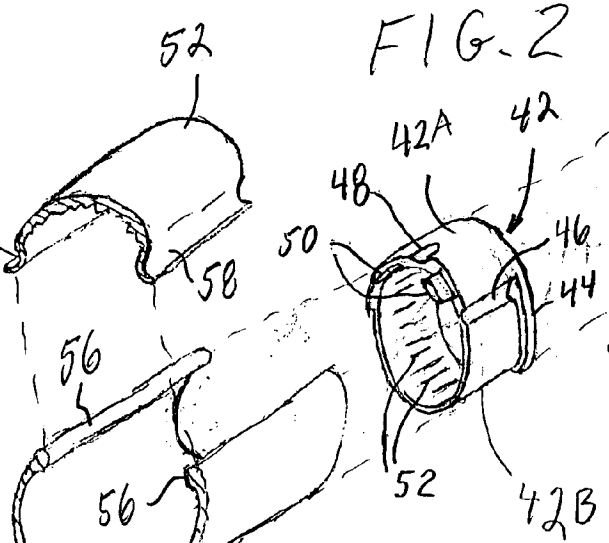
FIG. 3
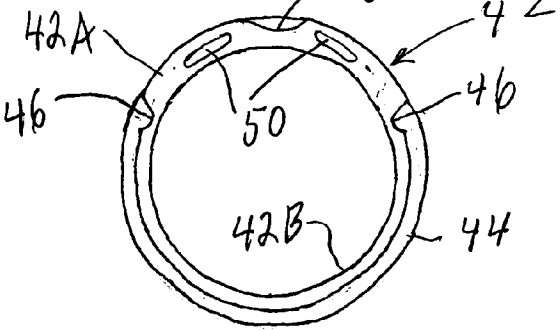

FIG. 10
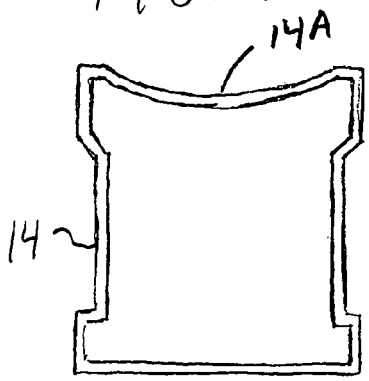
FIG. 6
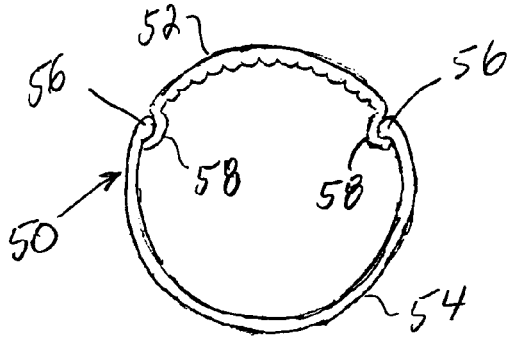
FIG. 11
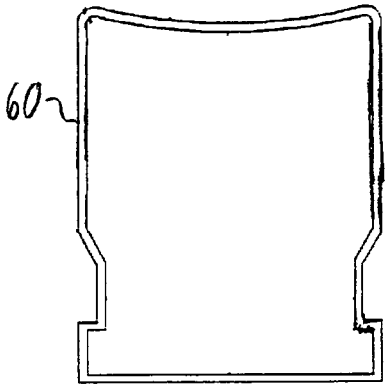
FIG 7
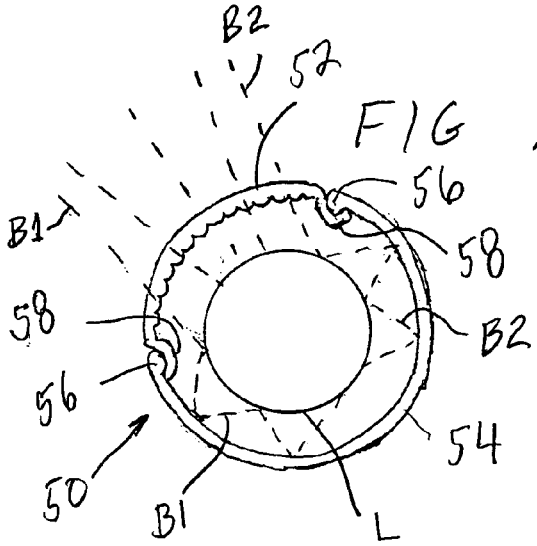
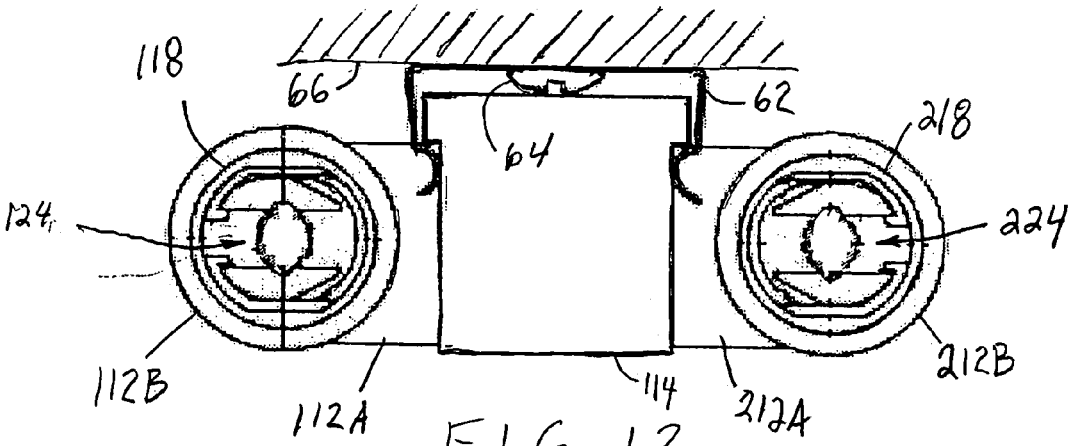
FIG. 12

DIRECTIONAL ADJUSTABLE SWIVEL LIGHTING-FIXTURE

BACKGROUND OF THE INVENTION

1. Field of the Invention

The present invention relates to directional lighting fixtures and in particular, to fixtures having rotatable reflective devices.

2. Description of Related Art

Lamp fixtures ought to be convenient and adaptable to various situations. For elongated lamps such as fluorescent lamps, a fixture may be designed as a single assembly with connectors that connect to the opposite ends of the fluorescent lamp. Such lamp fixtures are designed to be attached to ceilings, walls or other surfaces such as the underside of cabinets over a work surface.

Lamp fixtures often include a lamp cover that may have a diffuser to soften the light and avoid shadows with sharp edges. Such covers can also prevent dust collection inside the lamp fixture and also prevent individuals from touching the lamp or its electrical connectors. Because lamp life is limited, lamp fixtures should also be designed to facilitate lamp replacement. Therefore, lamp covers should be easily removed and reinstalled for the purpose of replacing lamps.

Such lamp fixtures may be manufactured as a single unit with an integral power switch and with connectors for bringing power to the fixture either through a power cord or other adapters. Also, power connectors can be designed to connect a number of lamp fixtures in series, daisy-chain style.

It is often desirable to direct light output to a desired location. For example, one may wish to balance the lighting in a room or workspace by adjusting the direction of the light from individual fixtures. In some cases the fixture may provide accent lighting or be designed to illuminate an area of interest such as a painting. Also, a lighting fixture may be mounted under a cabinet over a work surface but offcenter. In that case one may wish to redirect the light from the fixture to the center of the work surface. Moreover, one may wish to periodically readjust the direction of the lighting depending on what portion of the work surface requires the most lighting.

SUMMARY OF THE INVENTION

In accordance with the illustrative embodiments demonstrating features and advantages of the present invention, there is provided a directional lighting fixture adapted to receive an elongated lamp. The fixture has a spaced pair of connective devices each having a barrel with an electrical contact adapted to connect to opposite ends of the lamp. A tubular lamp cover has a light transmissive section and a light reflective section. Each section is contiguous to the other and trough-shaped. The lamp cover is rotatably mounted around the barrels of the connective devices.

In a disclosed embodiment a light fixture will have a relatively long housing attached at either end to a connective device supporting a barrel containing contacts that can connect to an elongated lamp, such as a fluorescent lamp. In this embodiment a collar is rotatably mounted on the barrel of each of the connective devices with ridges in striations that allow the collars to rotate but with the feel of having many detents.

A pair of trough-shaped sections snap together on the collars to form a lamp cover. In particular, a reflective section has a pair of longitudinal lips that can snap into longitudinal grooves on the collars. A light transmissive section has a pair of longitudinal channels that can snap over the longitudinal lips of the light reflective section to form a tubular lamp cover.

The direction of light emanating from the fixture can be adjusted by rotating the tubular lamp cover and the collars.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 2 is an exploded, perspective view, partly in section, of a portion of the fixture of FIG. 1;

FIG. 3 is in an end view of the collar of FIG. 2;

FIG. 6 is a separate end view of the light transmissive section and light reflecting section of the lamp cover of FIG. 1;

FIG. 7 is similar to FIG. 6 but showing a lamp installed;

FIG. 10 is in an end view of the tubular housing of FIG. 1;

FIG. 11 is in an end view of a tubular housing that is an alternate to that of FIG. 10; and FIG. 12 is an end view of a dual-lamp connective device that is an alternate to that of FIG. 5.

DETAILED DESCRIPTION OF THE PREFERRED EMBODIMENTS

Figure 1:
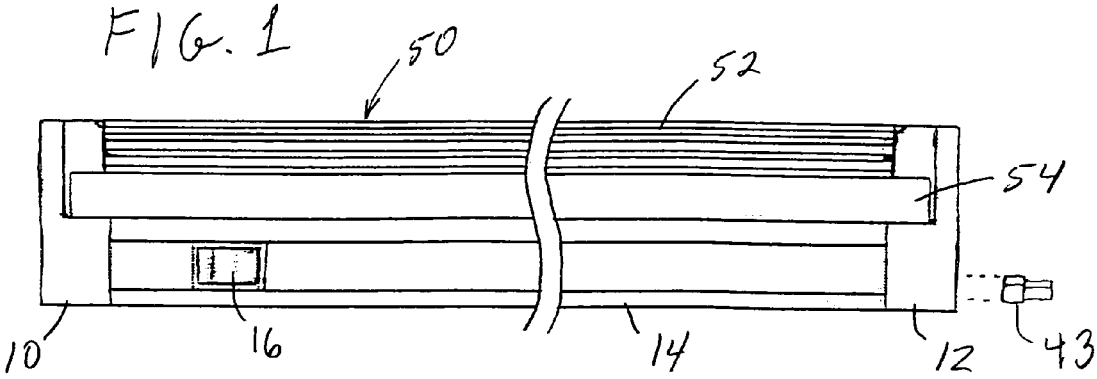
FIG. 1 is a side view of a directional lighting fixture in accordance with principles of the present invention.
Figure 5:
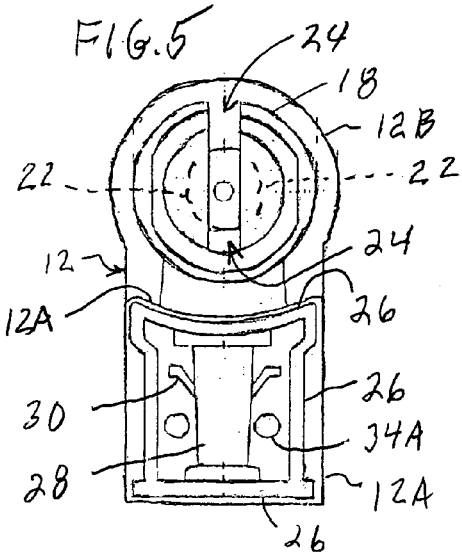
FIG. 5 is an inside end view of the connective device of FIG. 4.
Figure 4:
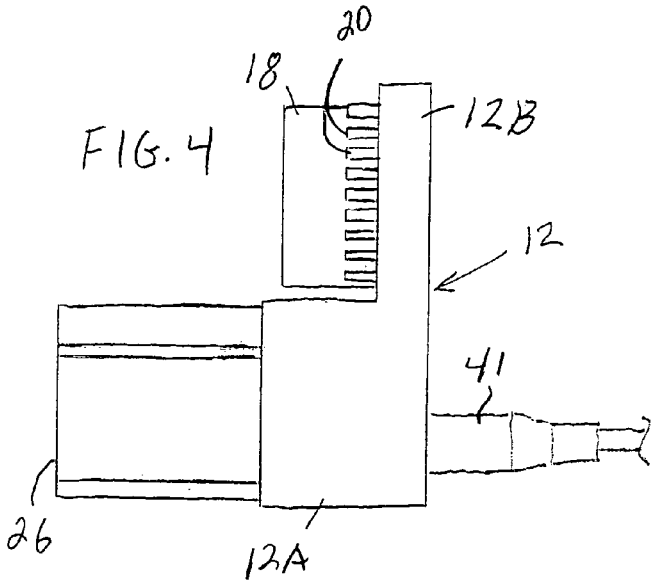
FIG. 4 is a side view of the connective device of FIG. 2.

Referring to FIGS. 1-10, a directional lighting fixture is shown as a pair of connective devices 10 and 12 interconnected by a tubular housing 14 and fitted with an optional electrical switch 16. Connective devices 10 and 12 are substantially the same and device 12 is shown comprising a hollow casing 12A having an upper portion 12B supporting a cylindrical barrel 18 with longitudinal ridges 20.

Barrel 18 has a twist-type electrical contact 22 or a spring loaded socket. Specifically, the pins (not shown) on an elongated fluorescent lamp L can slide through slot 24 and then swing into openings (not shown) in slot 24 to reach electrical contact 22.

An inwardly directed stub 26 projecting from casing 12A has an open end providing access to the inside of casing 12A. Visible in FIG. 5 through stub 26 is a reinforcing column 28 inside casing 12A. Also visible are a pair of dividers 30 in the form of cantilevered tabs designed to act as separating guides for wires (not shown) routed through connective device 12.

Figure 8:
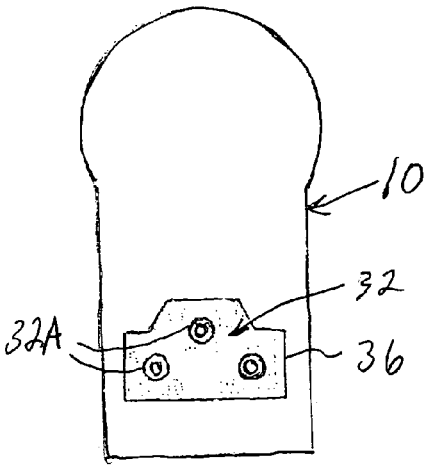
FIG. 8 is an outside end view of the connective device of FIG. 1 fitted with a male power connector.
Figure 9:
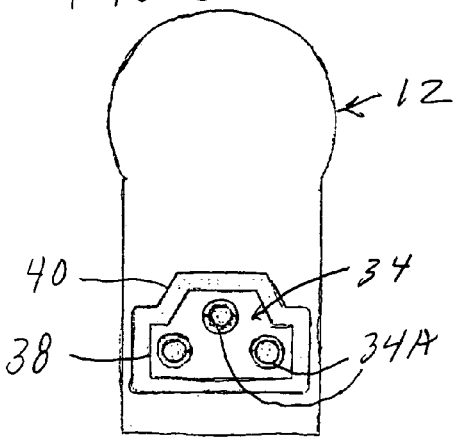
FIG. 9 is an outside end view of the connective device of FIG. 4 fitted with a female power connector.

The back of connective devices 10 and 12 have power connectors 32 and 34, respectively (see FIGS. 8 and 9). Power connector 32 is shown as a twin or trio of male connecting pins 32A located inside recess 36. Power connector 34 is shown as a trio of female connecting sockets 34A recessed in cavities in embossment 38 which is itself recessed inside well 40.

A plug (not shown) formed much like the embossment 38 (with sockets 34A) can be inserted into recess 36 (FIG. 8) to connect to pins 32A and supply power to connective device 10. Plug 41 (FIG. 4) is a shell designed to fit over embossment 38 (FIG. 9). Internal pins (not shown) inside the shell of plug 41 slip into sockets 34A. Plug 41 is intended to transmit power from sockets 34A to a similar lamp fixture or other device.

In some cases the present lamp fixture can be mounted end to end with a similar lamp fixture. The two lamp fixtures can be interconnected by an adapter 43 (FIG. 1) whose left end is designed to fit over the embossment 38 (FIG. 9) and connect to sockets 34A. The right end of adapter 43 is designed to plug into the recess 36 (FIG. 8) and connect to the pins 32A. Accordingly, the lamp fixtures can be daisy-chained together, end to end.

Collar 42 has a uniform inside diameter and an outside diameter that is uniform for the proximate 150° of sector 42A. Axial striations 52 exist over 360° of the inside of collar 42. Sector 42B has a smaller outside diameter except for flange 44 whose outside diameter is the same as that of sector 42A. Two longitudinal grooves 46 mark the transition between sector 42A and 42B. A short access gully 48 extends on the outside of collar 42 and reaches the center of the inside edge of sector 42A. Projecting axially from the inside edge of sector 42A are a pair of guide tabs 50 located on either side of and equidistant from gully 48.

A tubular lamp cover 50 comprises a light transmissive section 52 and a light reflective section 54. Section 54 is an aluminum extrusion painted white and or other finishes to enhance its reflecting capabilities. Section 54 is substantially frustro-cylindrical and extends approximately 210°. Section 52 is also substantially frustro-cylindrical and extends approximately 150°. Section 52 is a transparent plastic with an inside surface that is corrugated in order to make this section diffusive. The two longitudinal edges of section 52 are formed into a pair of channels 58. The two longitudinal edges of section 54 are formed into a rounded, inwardly directed pair of lips 56 designed to snap into channels 58.

Previously mentioned tubular housing 14 is an aluminum extrusion designed to slide over stubs 26 on each of the connective devices 10 and 12. As shown in FIG. 10, the top of housing 14 has a gutter-shaped surface 14A designed to accommodate the curvature of lamp cover 50. It will be appreciated that stubs 26 and housing 14 may, in other embodiments, have different outlines. Housing 60 of FIG. 11 is an example of such an alternate outline.

To facilitate an understanding of the principles associated with the foregoing fixture, its operation will be briefly described. The fixture can be wired in a conventional manner with wiring running through housing 14, and the devices 10 and 12 to deliver power to the electrical contacts 22, which by themselves are conventional. The fixture can be mounted to a surface by using mounting hardware such as a C-clip (not shown).

Housing 14 can also contain a conventional ballast/starter circuit, which is typically a solid-state circuit, although the more traditional inductive coil and switching contacts may still be used in some embodiments. In still other embodiments, a self-starting lamp may be employed in which case no starter circuitry will be necessary.

Collars 42 will be fitted over the barrels 18 of connective devices 10 and 12. With the gully 48 down, the lips 56 of reflective section 54 can be snapped into the grooves 46 of the collars 42. The collars 42 can then be rotated to bring the reflective section 54 down. Next the pins of lamp L can be slid through slot 24 before rotating lamp L approximately 180° in order to make connection with contacts 22. (It will be appreciated that the foregoing is a twist-type connector but that other embodiments can use different types of connectors.)

The channels 58 of light transmissive section 52 can now be snapped onto the lips 56 of reflective section 54. When properly positioned, the two ends of section 52 will rest on the tabs 50 of the collars 42. If the lamp L needs to be replaced, a user can remove section 52 by inserting a fingernail through gully 48 and under section 52 in order to lift this section.

With light transmissive section 52 installed, power can be supplied by inserting the plug of a power cord (not shown) into the power connector 32 (FIG. 8) to make contact with pins 32A. Switch 16 can then be operated to turn the lamp L on. If desired, a number of fixtures can be connected together by using the power output connector 34 of FIG. 9.

The light emanating from portions of lamp L adjacent to light transmissive section 52 follows a direct path, although some diffusion occurs due to the corrugations on the inside surface of section 52. Light emanating from portions of lamp L adjacent to reflective section 54 will reflect one or more times off the inside of section 54 and the outside of lamp L as suggested by multiply reflected ray B1 (moving clockwise) and multiply reflected ray B2 (moving counterclockwise).

A user can change the direction of the beam of light emerging through light transmissive section 52 by rotating section 52 and 54 in unison with collars 42. As collars 42 rotate, their striations 52 will interact with the ridges 20 on barrels 18. This will give the user the feel that the lamp cover 50 has a large number of detents.

In the embodiment of FIG. 12 components corresponding to those previously illustrated bear the same reference numerals except for being increased by either 100 or 200. In particular, housing 114 snaps into C-shaped clip 62, which is fastened by screw 64 onto mounting surface 66. It will be appreciated that similarly shaped C-clamps can be used to support the housings of the previously mentioned embodiments.

Longitudinal housing 114 is attached to a connective device having two casing branches 112A and 212A both terminating in casing section 112 and 212 supporting barrels 118 and 218, respectively. As before, barrels 118 and 218 contain lamp contacts accessible through slots 124 and 224, which the pins of a fluorescent lamp.

A complementary set of connective devices similar to that illustrated in FIG. 12 are attached to the opposite end of housing 114 in order to support a lamp at either end. Also, collars similar to that previously illustrated (collars 42 of FIG. 2) are mounted on barrels 118 and 218. Moreover, lamp covers identical to those previously illustrated (cover 50 of FIG. 6 comprising section 52 and 54) are mounted onto the collars on the barrels 118 and 218.

It is appreciated that various modifications may be implemented with respect to the above described, preferred embodiments. While the foregoing embodiments employed elongated lamps such as T4 or T5 fluorescent lamps other embodiments may operate with different types of gaseous discharge lamps, incandescent lamps, halogen lamps, LED, CCFL, EEFL, etc. Accordingly, the dimensions of the fixture will be adjusted to accommodate the specific lamp being handled. While power connectors were illustrated, in some embodiments these can be eliminated and the fixture can be hardwired. While the foregoing reflective section was a metal extrusion painted white (or other finishes), other embodiments may employ other materials that may be fitted with a reflective tape or by a separate reflector. Also, the two sections of the lamp cover can be connected by a hinge or may not be connected to each other and simply rely on the end collars to hold the two sections together. Also, while the lamp cover was illustrated with a cylindrical shape, in other embodiments its cross-section may be polygonal, oval, or shaped otherwise. In addition, light diffusion can be achieved through the lamp cover by corrugations, roughening of the surface, or by using a material that is inherently diffusive.

Obviously, many modifications and variations of the present invention are possible in light of the above teachings. It is therefore to be understood that within the scope of the appended claims, the invention may be practiced otherwise than as specifically described.

The invention claimed is:

1. A directional lighting fixture adapted to receive an elongated lamp, said fixture comprising:

a spaced pair of connective devices each having a barrel with an electrical contact adapted to connect to opposite ends of said lamp; and a tubular lamp cover having a light transmissive section and a light reflective section, each being contiguous to the other and trough-shaped, said lamp cover being rotatably mounted around the barrels of the connective devices.

2. A directional lighting fixture according to claim 1 wherein said light reflective section extends over a greater circumferential portion of said lamp cover than said light transmissive section.

3. A directional lighting fixture according to claim 1 comprising:

a pair of collars rotatably mounted on said barrels of said pair of connective devices, said lamp cover being mounted around said collars to rotate therewith.

4. A directional lighting fixture according to claim 3 wherein the barrel of each of said connective devices has a circumferentially spaced plurality of longitudinal ridges, said pair of collars each having a plurality of internal striations for engaging said longitudinal ridges.

5. A directional lighting fixture according to claim 3 wherein said lamp cover and said pair of collars are rotatable in unison through at least 180°.

6. A directional lighting fixture according to claim 3 wherein said lamp cover and said pair of collars are rotatable in unison through 360°.

7. A directional lighting fixture according to claim 3 wherein said light reflective section has a pair of longitudinal lips, said pair of collars each having a pair of longitudinal grooves sized to receive said pair of longitudinal lips.

8. A directional lighting fixture according to claim 7 wherein said light transmissive section has a pair of longitudinal channels adapted to hold said pair of longitudinal lips of said light reflective section.

9. A directional lighting fixture according to claim 8 wherein said light reflective section is longer than said light transmissive section.

10. A directional lighting fixture according to claim 1 wherein said light reflective section has a pair of longitudinal lips, said pair of collars each having a pair of longitudinal grooves sized to receive said pair of longitudinal lips, said light transmissive section having a pair of longitudinal channels adapted to snap onto said pair of longitudinal lips of said light reflective section.

11. A directional lighting fixture according to claim 1 wherein said light transmissive section is diffusive.

12. A directional lighting fixture according to claim 1 wherein each of said connective devices has a casing, said barrel extending longitudinally from said casing and having a circumferentially spaced plurality of longitudinal ridges, said casing having a stub spaced from and extending in the same direction as said barrel.

13. A directional lighting fixture according to claim 12 comprising:

a tubular housing mounted on the stub of each of said pair of connective devices to mechanically interconnect them.

14. A directional lighting fixture according to claim 13 wherein the tubular housing has a gutter-shaped surface facing said lamp cover.

15. A directional lighting fixture according to claim 13 wherein the electrical contact of each of the connective devices are adapted to connect to fluorescent lamps.

16. A directional lighting fixture according to claim 15 wherein the electrical contact of each of the connective devices are twist type.

17. A directional lighting fixture according to claim 15 wherein the tubular housing has a manually operable electrical switch.

18. A directional lighting fixture according to claim 12 wherein at least one of said connective devices has a power connector.

19. A directional lighting fixture according to claim 1 comprising a male and a female power connector separately mounted on respective ones of said connective devices.

* * * * *